US008347425B2

(12) United States Patent
Bronstein

(10) Patent No.: US 8,347,425 B2
(45) Date of Patent: Jan. 8, 2013

(54) SHOWER ATTACHMENT AND RELATED METHOD OF USE

(76) Inventor: Edgar L. Bronstein, Caracas (VE)

( * ) Notice: Subject to any disclaimer, the term of this patent is extended or adjusted under 35 U.S.C. 154(b) by 347 days.

(21) Appl. No.: 12/725,138

(22) Filed: Mar. 16, 2010

(65) Prior Publication Data

US 2011/0225723 A1 Sep. 22, 2011

(51) Int. Cl.
*A47K 3/022* (2006.01)
*A47K 3/00* (2006.01)

(52) U.S. Cl. ..... 4/605; 4/615

(58) Field of Classification Search ..... 4/615–617, 4/567–570, 601; 239/282, 283; 248/125.2, 248/124.1, 278.1
See application file for complete search history.

(56) References Cited

U.S. PATENT DOCUMENTS

| | | | | |
|---|---|---|---|---|
| 3,616,466 | A * | 11/1971 | Davis | 4/615 |
| 3,737,107 | A * | 6/1973 | Wright | 239/588 |
| 4,274,400 | A * | 6/1981 | Baus | 601/169 |
| 4,360,159 | A * | 11/1982 | Haynes | 239/282 |
| 4,561,136 | A | 12/1985 | Baer | |
| 5,829,072 | A * | 11/1998 | Hirsch et al. | 4/605 |
| 6,390,433 | B1 * | 5/2002 | Kasa-Djukic | 248/441.1 |
| 6,820,290 | B1 * | 11/2004 | Mullick et al. | 4/663 |
| 7,043,776 | B1 * | 5/2006 | Wu | 4/601 |
| 7,143,961 | B1 * | 12/2006 | Wu et al. | 239/446 |
| 8,141,834 | B2 * | 3/2012 | Mueller | 248/278.1 |
| 2003/0167565 | A1 * | 9/2003 | Yoshida | 4/606 |
| 2005/0039252 | A1 | 2/2005 | Fainberg | |
| 2005/0172396 | A1 | 8/2005 | Marrs et al. | |
| 2009/0293190 | A1 * | 12/2009 | Ringelstetter et al. | 4/605 |

FOREIGN PATENT DOCUMENTS

| | | |
|---|---|---|
| JP | 3195523 | 8/1991 |

* cited by examiner

*Primary Examiner* — Gregory Huson
*Assistant Examiner* — Janie Christiansen
(74) *Attorney, Agent, or Firm* — Allen, Dyer, Doppelt, Milbrath & Gilchrist, P.A.

(57) ABSTRACT

The invention is directed to a shower attachment capable of affixing to a standard residential or commercial shower enclosure. The shower attachment uses existing plumbing to supply pressurized water to a water intake, which in turn feeds a vertical assembly. The vertical assembly includes a stabilizing rod having a top end and corresponding back end. A pivot arm having a first portion and corresponding second portion connects to the stabilizing rod. A detachable shower wand is positioned at the second portion of the pivot arm, which is capable of receiving pressurized water from the water intake. In addition, a horizontal assembly connects to the bottom end of the shower attachment to secure the device to the shower enclosure.

16 Claims, 9 Drawing Sheets

SHOWER ATTACHMENT AND RELATED METHOD OF USE

FIELD OF THE INVENTION

This invention is directed to a shower attachment that can rotate and pivot about a user to deliver a shower. The invention also relates to a system that attaches to an existing shower enclosure for purposes of delivering an automated shower.

BACKGROUND OF THE INVENTION

Traditional shower systems used over the past 50 years have primarily included a showerhead and a series of valves for regulating the temperature of the shower (as well as control the follow of water to the showerhead). Most advances have been in the field showerhead design including various showerheads that variate flow of pressurized water to effectuate a massage. Other advances have included placement of multiple showerheads in series to create an envelope or cascade of water around a user. These additional showerheads are placed along the shower enclosure wall, or event on the ceiling of the shower. All of these advances have focused on the same fundamental shower system of a showerhead and regulating valves.

Review of patents dealing with shower systems highlights these limited advances. U.S. Pat. No. 4,563,780 entitled "Automated Bathroom" is directed to a system for regulating bathroom activities such as showering. However, the invention primarily relates to introducing bath additives and cleaning solutions to maintain the cleanliness of the bathroom.

Showering remains a fundamental regiment to ensure cleanliness as well as reduce the spread of disease. This is especially true and important in hospitals, nursing homes and assisted living facilities. It is often the case that individuals being treated at these facilities have infirmities that prevent them from showering without assistance. However, assistance when showering is not only uncomfortable and embarrassing for the informed individual—but also requires a significant level of time and patience on the part of the professional assisting.

Very little has been done to create shower systems to assist infirmed individuals who cannot stand upright to take a shower.

Apart from shower systems for assisting infirmed individuals, there have also been very little advances in the field of automated shower systems for domestic use for effectuating a spa like experience. Current shower systems can optionally include a hand wand that is attached to the regulating valves. A flexible tube attaches the hand wand to the regulating valves such that the user can have greater freedom to provide direct water pressure to various parts of the user's torso. Optionally, these hand wands can include settings to allow changes in pressure. By engaging the hand wand, water is diverted from the showerhead (typically located above the wand) thus allowing for a more spa like feel.

Accordingly, there is a need in the art of shower system design for a robust attachment to an existing shower system to allow an infirmed individual to shower without need of assistance. Moreover, such attachment should provide a complete shower to those infirmed individuals with limited motor skills. In addition, there is a need in the art of domestic shower systems for an attachment that provides a spa like massage. Preferably, such device can be interchangeably used for both domestic and assisted living facilities in order to be mass-produced in a cost effective manner.

SUMMARY OF THE INVENTION

The current invention solves many of the limitations and shortcomings found in the art of shower systems. The invention is directed to a shower attachment capable of affixing to a standard residential or commercial shower enclosure. The shower attachment uses the existing plumbing to supply pressurized water to a water intake, which in turn feeds a vertical assembly. The vertical assembly includes a stabilizing bar having a top end and corresponding bottom end. A pivot arm having a first portion and corresponding second portion perpendicularly connects to the stabilizing bar. A detachable shower wand is positioned at the second portion of the pivot arm, which is capable of receiving pressurized water from the water intake. In addition, a horizontal assembly connects to the bottom end of the shower attachment to secure the device to the shower enclosure.

The vertical assembly can also include a vertical positioning member, which can be a chain drive, to orient the shower wand at a desired vertical height. This chain drive may include a top gear rotator, a corresponding bottom gear rotator, a linked chain and a first motor. The top gear rotator is positioned at the top end of the stabilizing bar and can include a first gear having threads of a sufficient size and dimension to engage the linked chain. The chain drive further includes a bottom gear rotator having a second gear having threads of a sufficient size and dimension to engage the linked chain. The bottom gear rotator is positioned proximate to the bottom end of the stabilizing bar. The first motor drives the linked chain in either of two vertical directions (up and/or down).

The first portion of the pivot arm can include a sleeve of sufficient size and dimension to engage a portion of the stabilizing bar to help vertically position the shower wand. This first portion can also engage the linked chain of the chain drive to assist in this vertical positioning.

The shower wand attached to the second portion of the pivot arm includes a head having a plurality of jets and a selector (which determines a preferred group of jets to engage). In addition, the shower wand can also have a handle, which can optionally include a hand grip. A cradle can be positioned at the distal end of the second portion of the pivot arm. This cradle has a first side and corresponding second side, which forms a clip to hold and maintain the handle of the shower wand. This cradle may include a second motor to rotate the shower wand when stationed within the clip.

The horizontal assembly includes a track system having a first and second track in parallel to one another, as well as a tram having both a third and forth motor. The tram has a recess to secure the bottom end of the stabilizing bar of the vertical assembly. The third motor helps horizontally move the vertical assembly, while the forth motor helps rotate the bottom end of the stabilizing bar. A controller (positioned on the vertical assembly), having a power supply, communicates with the four above-identified motors to mechanically position and orient the shower wand about a user. Optionally, the controller can include a memory device and a processor to store and perform various programs.

The invention is further directed to a method of using the shower attachment to provide an improved shower. The method first comprises the step of vertically positioning a shower wand to a desired height. The shower wand is connected to a vertical assembly by a pivot arm having a first portion and a corresponding second portion, where the vertical assembly includes a stabilizing bar having a top end and a corresponding bottom end.

The second step is to horizontally position the shower wand to a desired horizontal position within a shower enclosure through use of a horizontal assembly. Here, the horizontal assembly includes a tram connected to a track system. The tram has a recess of a sufficient size and dimension to receive the bottom end of the stabilizing bar. The third step of the method is to turn the shower wand about the horizontal assembly. The fourth step is to rotate the pivot arm to a desired orientation through turning the stabilizing bar about the tram.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The Overall Apparatus

Figure 1:
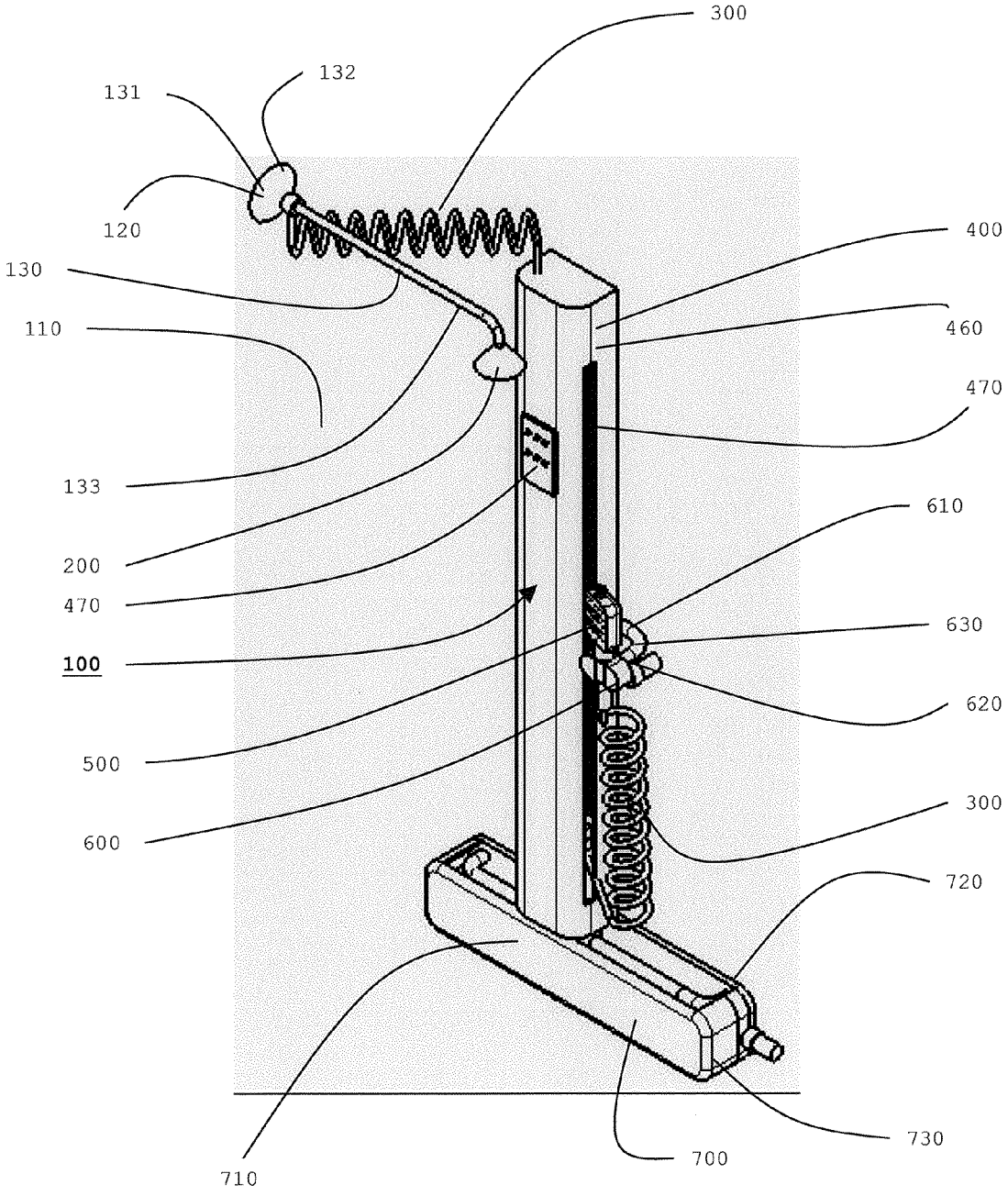
FIG. 1 is a perspective view of the shower attachment that includes a pivoting hand wand.

With reference initially to FIG. 1, the overall apparatus taught by the invention relates to a shower attachment 100 which can be fitted into an existing shower enclosure 110 located in any domestic or commercial facility. In one contemplated use, the shower attachment 100 can be used within a residence to aid and assist in providing a total body cleansing. Such application can offer a spa like experience by enveloping a user with a variety of angled jet sprays. In addition, the apparatus can alternatively be used to ensure proper cleansing of a child or other individual with low motor function.

In a second contemplated use, the shower attachment 100 can be use in a medical facility such as a hospital, nursing home or assisted care facility to allow the elderly or infirmed to shower in privacy with a reduced need for assistance and supervision by a medical professional. Such application ensures not only privacy but decreases the spread of disease within such facilities—as it will increase the frequency of the infirmed to seek and receive a total body cleansing. Other applications of the shower attachment 100 shall be known and understood by those of ordinary skill in the art upon review of the figures and disclosure contained herein.

FIG. 1 offers, by way of example, one preferred arrangement of the shower attachment 100. As illustrated, the shower attachment 100 preferably includes a fixed showerhead 200, a water intake 300, a vertical assembly 400, a shower wand 500 that connects to the vertical assembly 400 through a pivot arm 600, and a horizontal assembly 700. The shower attachment 100 can be automated or used manually depending upon the application and user need.

As further illustrated, the shower attachment 100 is self-contained, designed to fit within a traditional shower enclosure 110, and can use the existing plumbing to supply the requisite pressurized water. Accordingly, there is no need to re-plumb an existing shower enclosure 110 to use the apparatus. This saves not only money but allows for ready assembly and use of the shower attachment 100.

A manifold 120 attached to the shower enclosure 110 helps employ the existing plumbing. Positioned where the pre-existing showerhead was located, the manifold 120 creates two different streams of pressurized water 130: a first stream 131 and a corresponding second stream 132. The first stream 131 of pressurized water 130 feeds into a conduit 133, which in turn connects with the fixed showerhead 200. The fixed showerhead 200 provides a constant vertical shower of pressurized water 130 onto the user. This fixed showerhead 200 can be of a similar design, orientation and function of traditional showerheads.

As is further shown in FIG. 1, the second stream 132 is in communication with a water intake 300 that supplies the vertical assembly 400. The water intake 300 can be a hose, tube, conduit or similar structure capable of supplying pressurized water 130 to the vertical assembly 400, which in turn supplies the shower wand 500 (either directly or indirectly). One key design consideration contemplated by the invention is to have a sufficient length for the water intake 300 to allow the horizontal assembly 700 to move about the shower enclosure 110. Such design consideration must include where the shower attachment 100 is placed in relation to the manifold 120. For example, if the shower attachment 100 is placed on the same wall of the shower enclosure 110, then a smaller water intake 300 is necessary. If the shower enclosure 110 must be placed on another wall—the water intake 300 must be longer.

Regardless of its size or position, the water intake 300 feeds into the vertical assembly 400, which in turn supplies pressurized water 130 to the shower wand 500. FIG. 1 offers, by way of example, one form of the vertical assembly 400. The vertical assembly 400 can take numerous forms and can be accomplished by varying designs and orientations—to provide a variety of functionality. Regardless, the primarily role of the vertical assembly 400 is to vertically position the pivoting arm 600 to different desired elevations within the shower enclosure 110. Optionally, the vertical assembly 400 may also help turn the pivot arm 600 about the horizontal assembly 700. The vertical assembly 400 can accomplish these preferred elevations and pivots through use of mechanical pulleys, motors, hydraulics or combination thereof.

The pivot arm 600 represents an important component of the shower attachment 100. As illustrated in FIG. 1, the pivot arm 600 is essentially "L" shaped having a first portion 610, a second portion 620 and an elbow 630 (which attaches the first portion 610 to the second portion 620 at a desired angle). Located on the second portion 620 is the shower wand 500. The pivot arm 500 is capable of rotating at least 90 degrees about the vertical assembly 400. The length and dimension of the pivot arm 600 can be scaled based upon not only the user by the desired use of the shower attachment 100. For example, a user with a wider girth may require a longer first portion 610 of the pivot arm 600.

The shower wand 500 connected to the second portion 620 of the pivot arm 600 provides a second source of pressurized water 130. This shower wand 500 is in communication with the water intake 300 through a series of conduits or tubes housed within the vertical assembly 400. The shower wand 500 can be coupled to the second portion 620 of the pivot arm 600. Accordingly, a user can optionally remove the shower wand 500 for manual use—which can later be returned to the pivot arm 600. When positioned on the pivot arm 600, the shower wand 500 is capable of rotating at least 90 degrees about the pivot arm 600—in addition to the degree of rotation capable by the vertical assembly 400.

Positioned below the vertical assembly 400 is the horizontal assembly 700. Although the horizontal assembly 600 can take on various shapes and configurations, its primary role is to transport the vertical assembly 400 from one end of the shower enclosure 110 to the other. Put another way, the horizontal assembly 700 functions to guide and control the vertical assembly throughout the length of the shower enclosure 110. While this can be accomplished through several mechanisms known to those of ordinary skill the art, the preferred embodiment includes use of a series of tracks affixed to the base or side wall of the shower enclosure 110. Moreover, the horizontal assembly 700 can include use of mechanical pulleys, motors, hydraulics or combination thereof to supply sufficient energy to move the vertical assembly 400.

While FIG. 1 and the foregoing illustrate and describe one embodiment of the shower attachment 100, other assemblies will be recognized and understood by those of ordinary skill in the art now having the benefit of the teachings of the present invention.

The Vertical Assembly

Figure 2A:
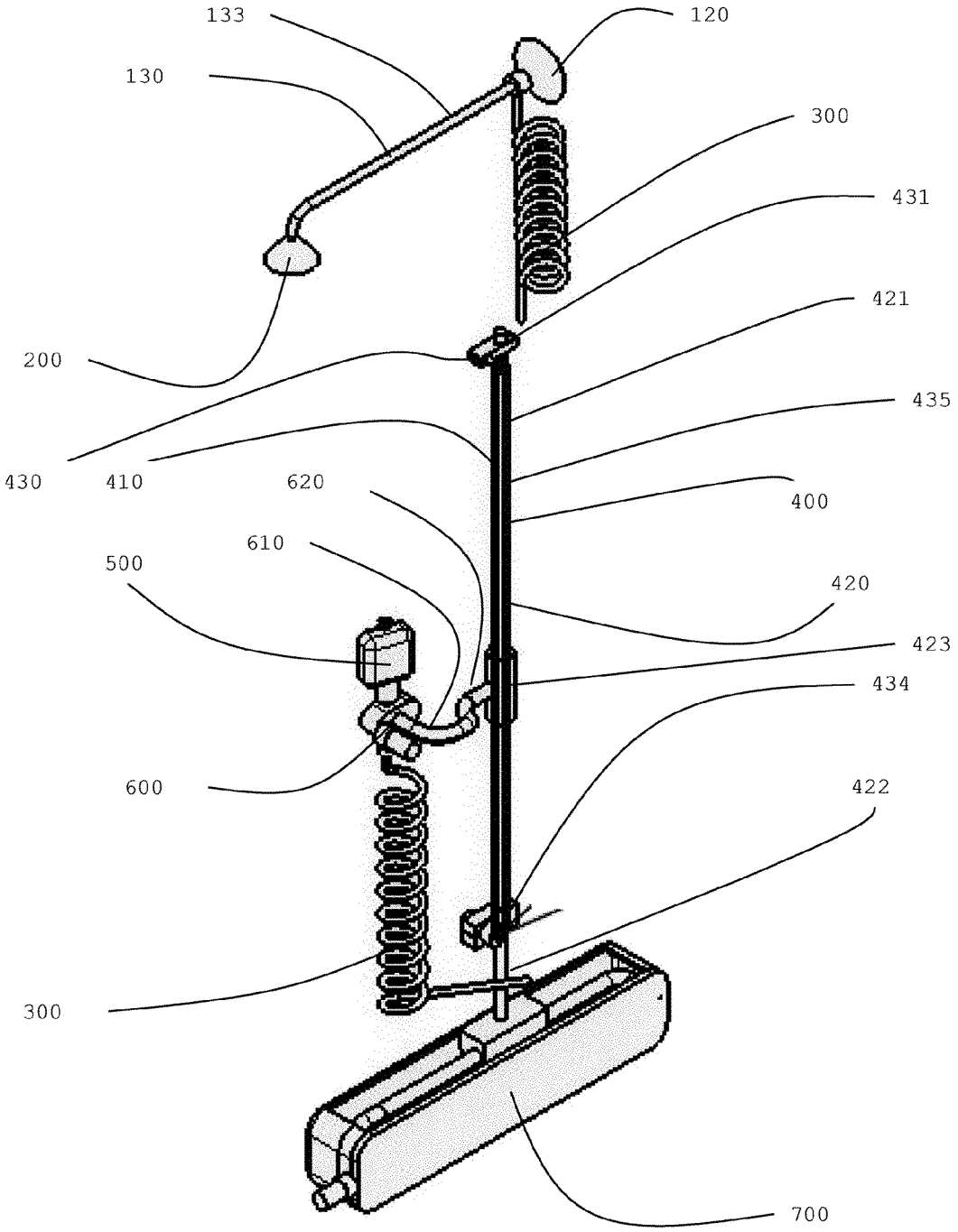
FIG. 2A is a perspective view of the shower attachment showing the internal components of the vertical assembly.
Figure 2B:
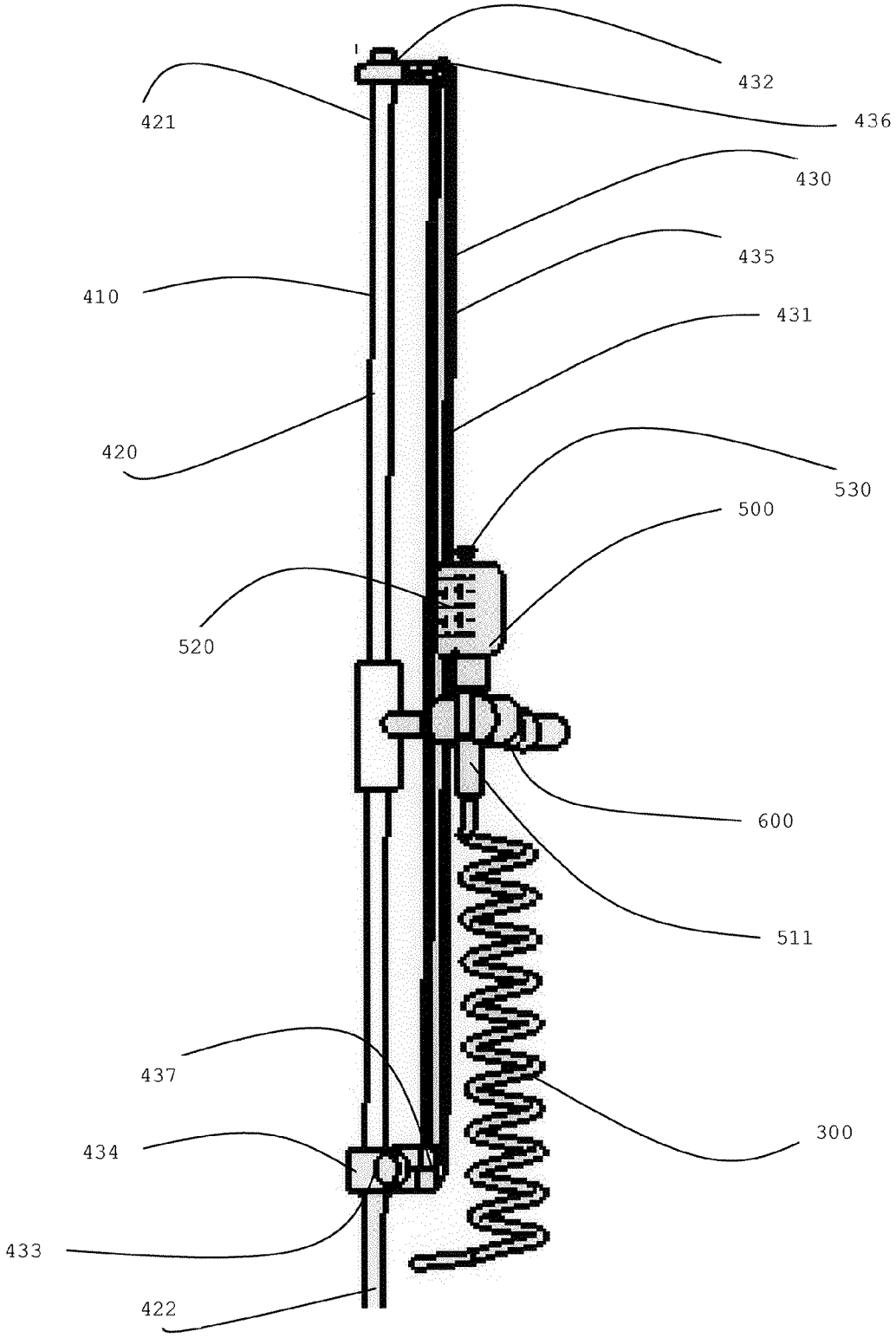
FIG. 2B is a perspective view of the chain train of the vertical assembly.
Figure 3:
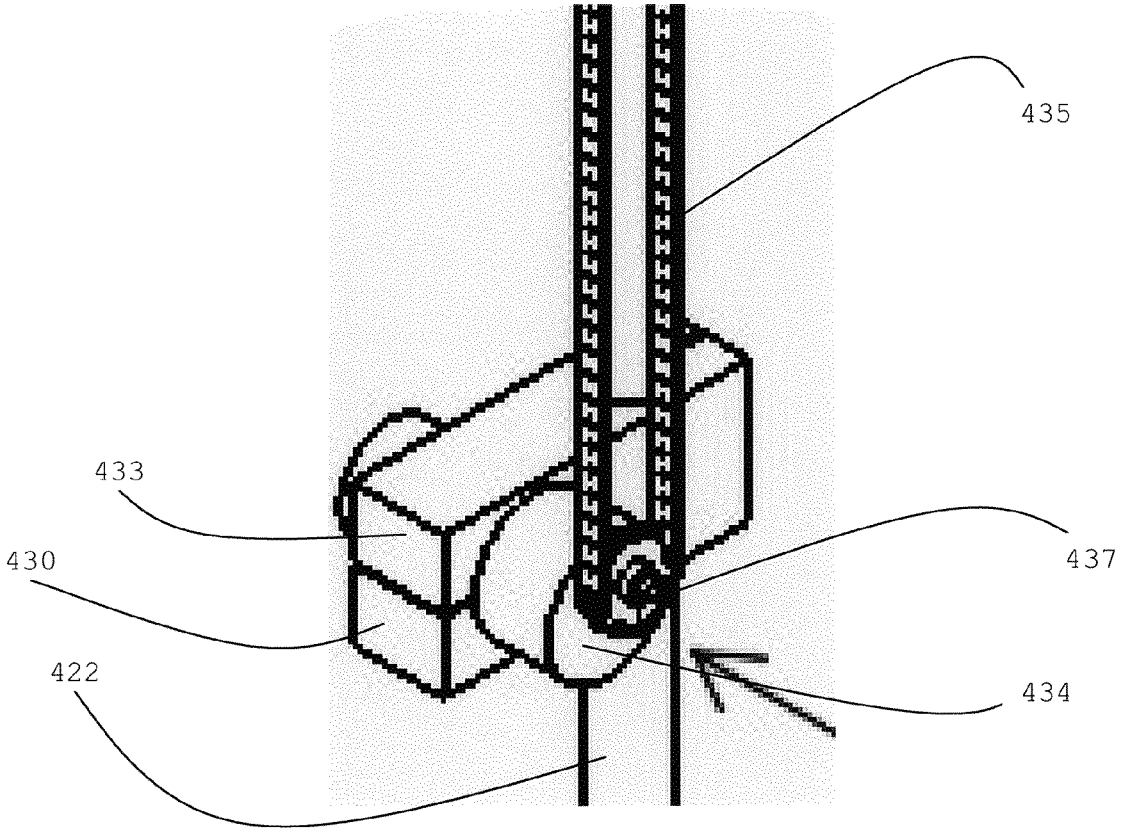
FIG. 3 is a perspective view of the vertical positioning member.

FIGS. 2A through 3 offer, by way of example, a more detailed view of the components of the vertical assembly 400. FIG. 2A offers one illustration of the internal components 410 of the vertical assembly 400. As shown, the internal components 410 preferably include a stabilizing bar 420, a vertical positioning member 430, and a coupler 440 (which connects to the first portion 610 of the pivot arm 600).

The stabilizing bar 420 functions as the primary support structure of the vertical assembly 400. As shown in FIG. 2A, the stabilizing bar 420 includes a top end 421, a corresponding bottom end 422 and a middle portion 423. The bottom end 422 of the stabilizing bar 420 connects with the horizontal assembly 700 (described in detail below). The stabilizing bar 420 also functions to secure the water intake 400 into the vertical assembly 400 to supply pressurized water 120 to the shower wand 500. While preferably made of a lightweight metal such as aluminum, the stabilizing bar 420 can be made of any similar lightweight and rigid material such as composite or plastic.

As shown in FIG. 2B, the internal components 410 of the vertical assembly 400 can also include a vertical positioning member 430. While the vertical positioning member 430 can take a variety of forms, its primary function is to position the pivot arm 600 at various vertical highs about the shower enclosure 110. As shown in FIG. 2B, one version of the vertical positioning member 430 is a chain drive 431.

The chain drive 431 includes at four primary components: a top gear rotator 432, a corresponding bottom gear rotator 433, a first motor 434 and a linked chain 435. Although FIGS. 2B and 3 contemplate use of a chain 435, a rope, cable or similar structure can be used. As shown in FIG. 2B, the top gear rotator 432 attaches to the top end 421 of the stabilizing bar 420. Likewise, the bottom gear rotator 433 attaches to proximate to the bottom end 422 of the stabilizing bar 420.

The top gear rotator 432 includes a first gear 436, while the corresponding bottom gear rotator 433 includes a second gear 437. Both the first gear 436 and second gear 437 have threads of sufficient size and dimension so as to engage the linked chain 435. Positioned within either the top gear rotator 432 or the bottom gear rotator 433 is a first motor 434. The first motor 434 is preferably electric driven—and is supplied energy from either an external power source or through a battery system. Regardless of position, the first motor 434 drives the chain 435, which then rotates about both gears (436 and 437).

FIG. 3 provides a more detailed view of the bottom gear rotator 433. A first motor 434 located within the bottom gear rotator 433 helps spin the second gear 437. Accordingly, the threads of the second gear 437 engage the chain 435—such that the chain 435 moved vertically up or down.

Attached at a desired link within the chain 435 is a coupler 440. As shown in greater detail in FIGS. 2A and 2B, the coupler 440 includes a sheath 441 which surrounds the stabilizing bar 420 as well as a connector 442 which attaches with some section of the chain 435. The coupler 440 (through both the sheath 441 and the connector 442) attaches and secures the first portion 610 of the pivot arm 600 to the vertical assembly 400. Accordingly, when the chain 335 moves up or down, the connector 442 helps move the sheath 441 vertically about the stabilizing bar 420. This in turn moves the pivot arm 600 in relation to the vertical assembly 300.

Figure 4:
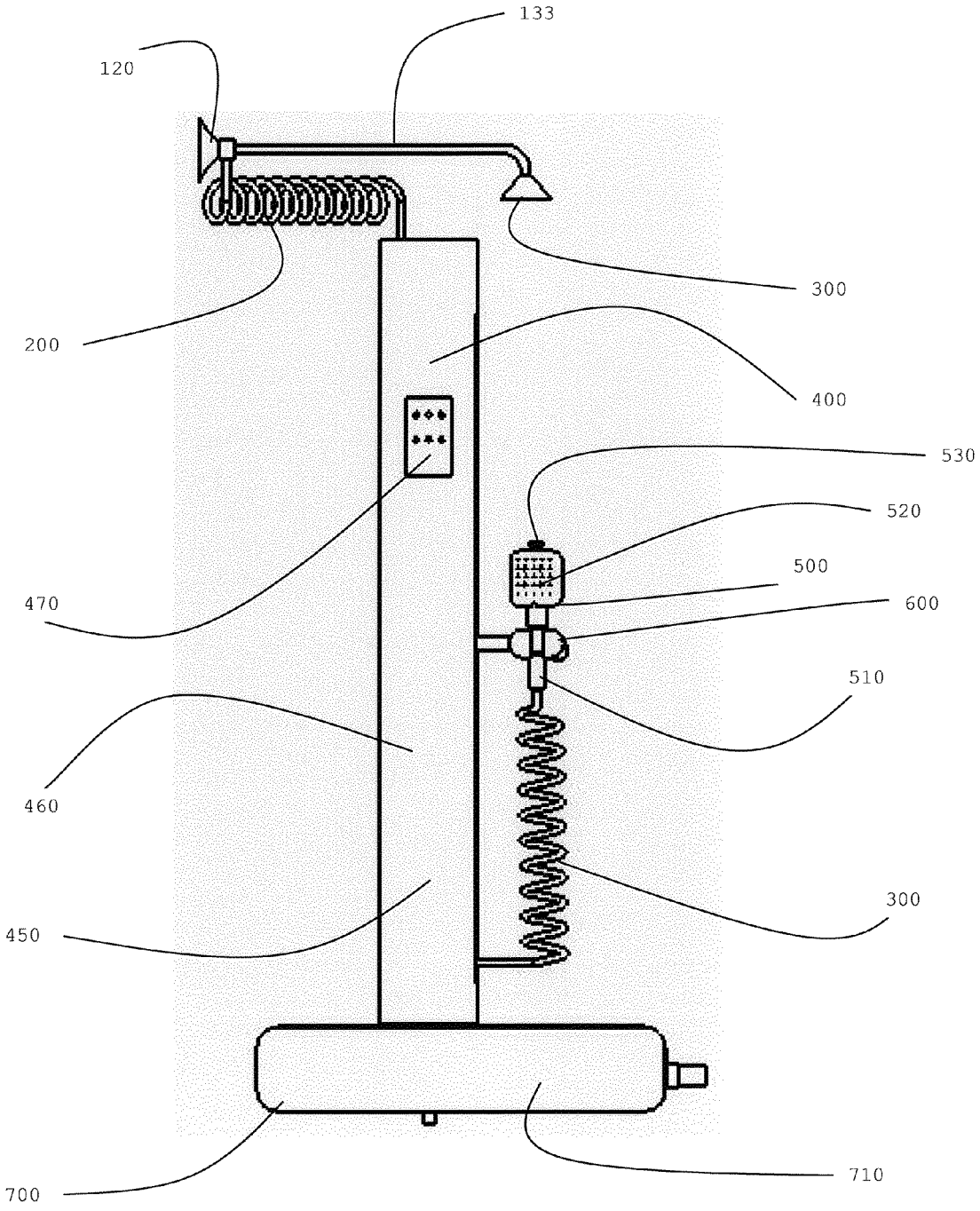
FIG. 4 is a front view of the shower attachment illustrating the external components of the vertical assembly.

FIG. 4 illustrates the exterior components 450 of the vertical assembly 400. As shown in FIG. 4, the exterior components 450 include an exterior housing 460, as well as a controller 470 (described in greater detail below). The exterior housing 460 is of sufficient size and dimension to secure and maintain all of the various internal components 410 of the vertical assembly 400. In addition, the exterior housing 460 includes a vertical slit 470 (shown in FIG. 1). This slit 470 is an opening of sufficient size and dimension to allow the pivot arm 600 to not only move vertically up and down in comparison with the shower enclosure 110—but also to sufficiently rotate to provide the shower.

The Shower Wand

Figure 5:
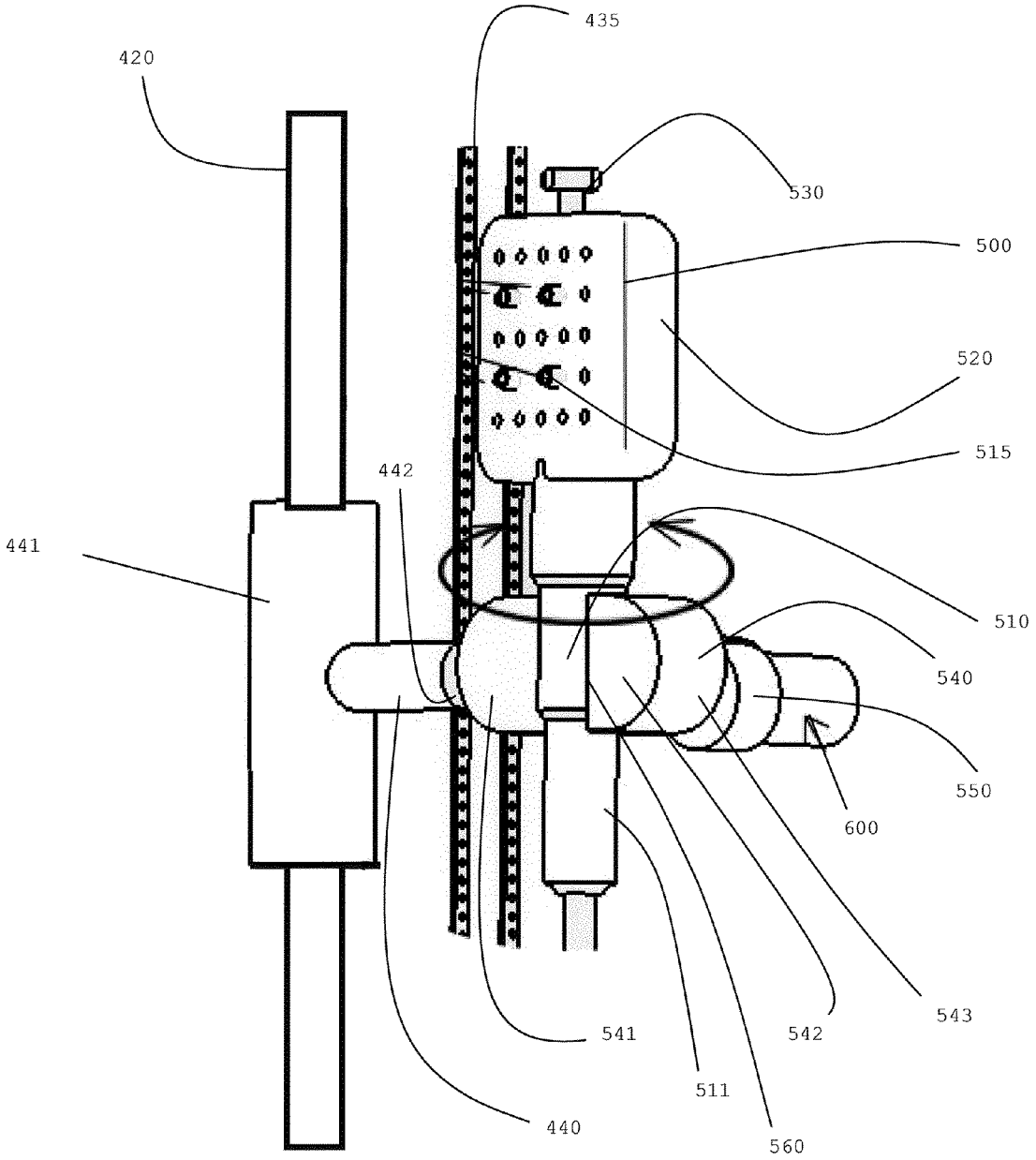
FIG. 5 is a perspective view of the various components of the shower wand.

FIG. 5 provides a more detailed illustration of one example of the shower wand 500. While the fixed showerhead 200 (illustrated in FIG. 1) functions to supply a source of pressurized water 130, the shower wand 500 is designed to pivot and move about the user to provide a second and perpendicular cascade shower. As shown, the shower wand 500 itself includes a handle 510, a head 520, and a selector 530. The handle 510 allows the shower wand 500 to be removed from the pivot arm 600 for manual operation. It is preferable, but not necessary, for the handle 510 to include a hand grip 511.

The shower wand 500 further includes a head 520, which includes a plurality of jets 515 to provide pressurized water 110 in the form of a shower. Attached to the head 520 is a selector 530. The selector 530 allows various settings to select which type of jets 515 to be used. Such settings allow various types of jets 515 to be engaged and disengaged to provide different orientations of pressurized water 120 onto the user. Thus, the selector 530 can create different types of massage such that the user can have a spa like experience.

FIG. 5 also illustrates how a cradle 540 is positioned at the distal end of the second portion 620 of the pivot arm 600. The cradle 540 includes a first side 541 and a corresponding second side 542 which form a "C" shaped clip 543 capable of gripping the handle 510 of the shower wand 500. Positioned within the cradle 540 is a two directional second motor 550. The second motor 550 powers a rotating grip wheel 560. When the shower wand 500 is placed within the cradle 540, the rotating grip wheel 560 can engage the handle 510. This can allow the wand 500 to rotate at least 90 degrees in either direction through rotation of the rotating grip wheel 560.

FIGS. 1, 2A and 2B show how the water intake 300 connects to the handle 510 of the shower wand 500. Accordingly, the shower wand 500 maintains a constant source of pressurized water 130.

The Horizontal Assembly

Figure 6:
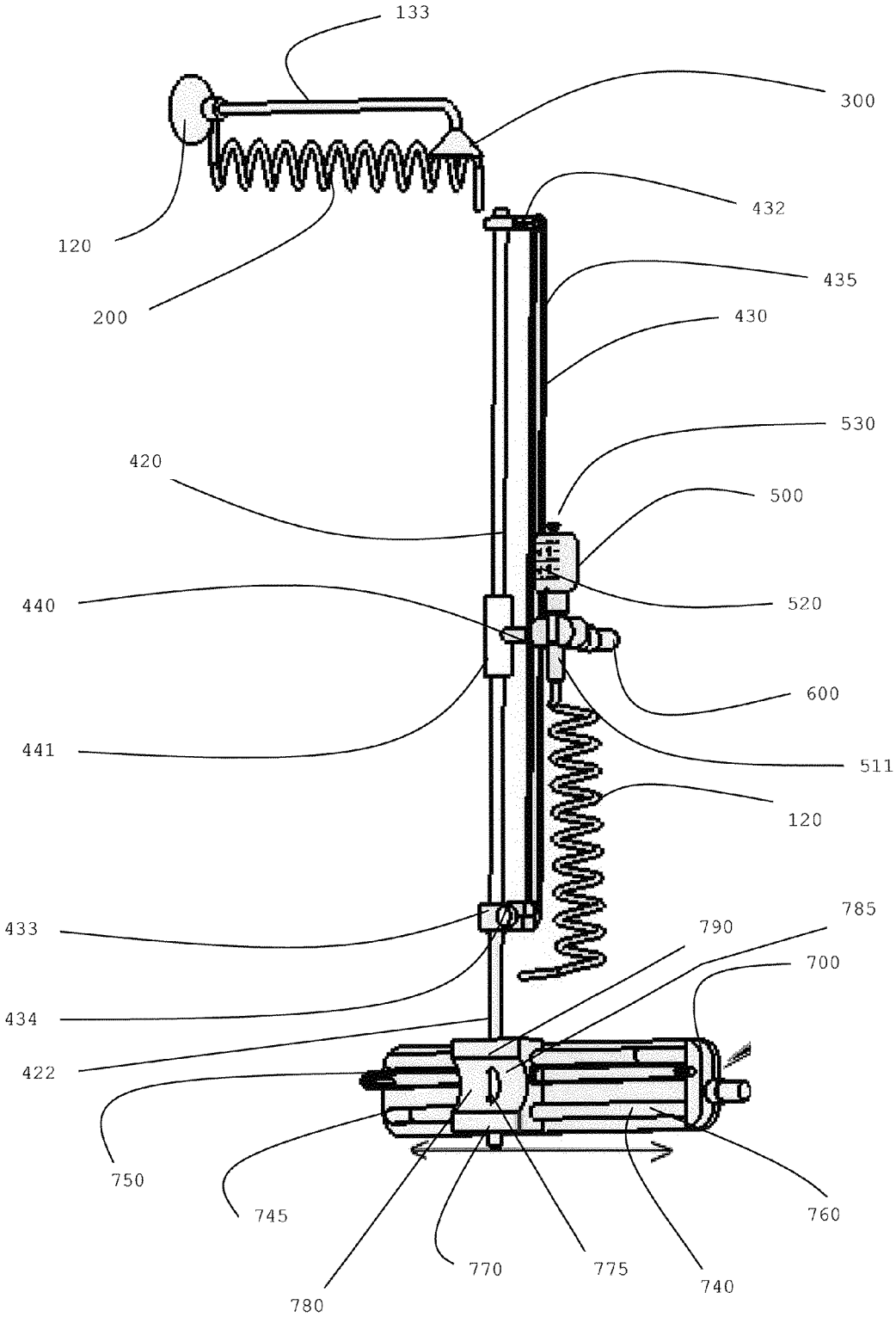
FIG. 6 is a first perspective view of the horizontal assembly.
Figure 7:
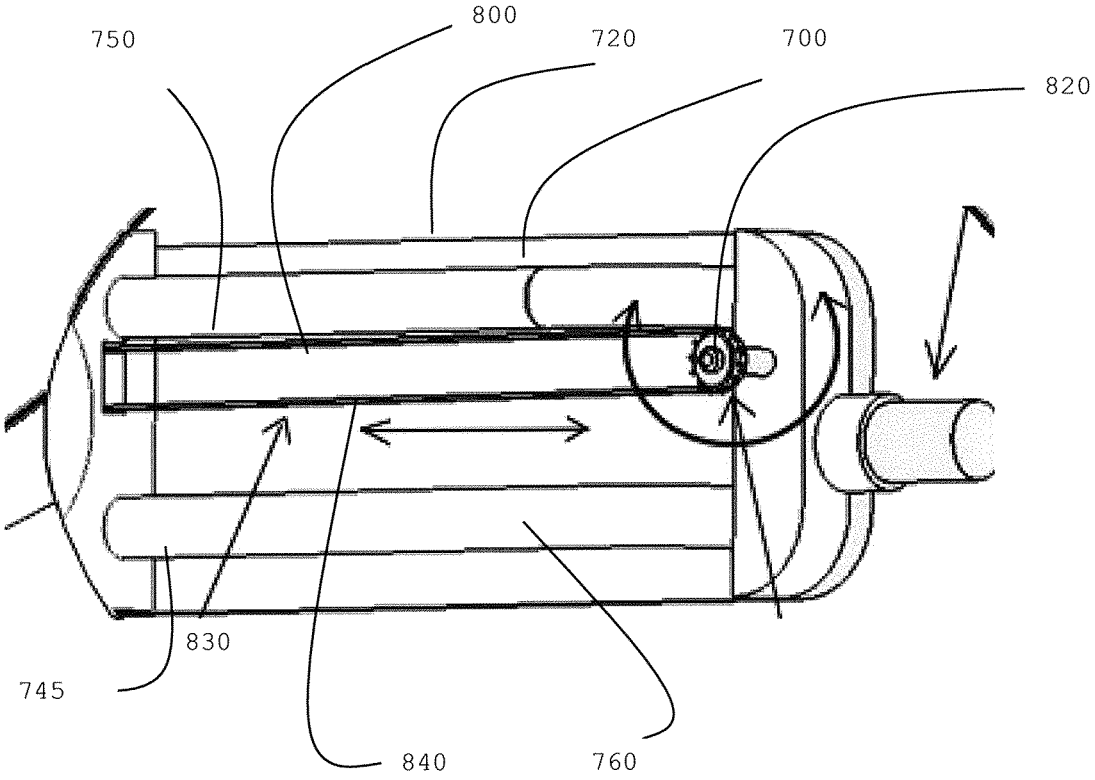
FIG. 7 is a second perspective view of the horizontal assembly.

FIGS. 1, 6 and 7 offer, by way of example, one version of the horizontal assembly 700 of the shower attachment 100. The horizontal assembly 700 can attach either to a wall or the floor (base) of the shower enclosure 110. As shown in FIG. 1, the horizontal assembly 700 includes a first wall 710 and a corresponding second wall 720. The first wall 710 is in parallel relationship with the second wall 720. Both walls 710 and 720 form the housing 730 of the horizontal assembly 700.

FIG. 6 illustrates the internal components 740 of the horizontal assembly 700. As shown, the internal components 740 include a track system 745 that includes a first track 750 and a corresponding second track 760. Both tracks 750 and 760 have the same length and are in parallel relation to one another. Resting on the track system 745 is a tram 770. The tram 770 can include both a third motor 780 and a fourth motor 790. The third motor 780, located within the tram 770, helps horizontally transport the tram 770 from one side of the horizontal assembly 700 to the other. This can be accomplished through a first friction wheel 785 in communication with the third motor 780 and either the first track 750 or second track 760.

Positioned within the tram 770 is a recess 775 capable of receiving and maintaining the stability rod 410. Accordingly, the tram 770 helps hold and position the vertical assembly 400. Positioned in communication with the recess 775 is the fourth motor 790. This fourth motor 790 can communicate with a second friction wheel 795 that allows the stability rod 410 to pivot and rotate within the recess 775.

FIG. 7 offers an alternative embodiment of how to transport the tram 770 from one side of the horizontal assembly 700 to the other. As shown in FIG. 7, a second chain drive 800 can be positioned within the first and second tracks (750 and 760). The second chain drive 800 includes a first gear 810 (not shown) and a corresponding second gear 820. Both gears 810 and 820 include threads 830 of a sufficient size and dimension so as to engage the links of chain 840. The third motor 780 is in communication with either the first gear 810 or second gear 820 in order to power the chain 840. In addition, the tram 770 (shown in FIG. 6) is in communication with the chain 840 in order to position and move the tram 770 about the horizontal assembly 700.

The Controller

As shown in FIG. 1, the shower attachment 100 can include a controller 470. The controller 470 is preferably in communication with each of the four motors (434, 550, 780 and 790). This can be accomplished either through hard wire, radio or wireless capability. Accordingly, the controller 470 offers the ability to manually control the height, positioning, and angle of the shower wand 500. This is accomplished through four or more switches 471 on the controller 470. The controller 470 preferably has its own self-contained power source 472, which can be a battery.

Optionally, the controller 470 can include a processor 473 and a memory device 474 capable of storing one or more sets of programs 475. These programs 475 can include a timer and/or several routines in which the vertical assembly 400, pivot arm 600 and shower wand 500 can rotate about the user. These programs can include changing the selector 530 on the hand wand 500—for a selected type of jet 515. These programs 475 can be pre-set or manually created through use of the controller 470.

Figure 8:
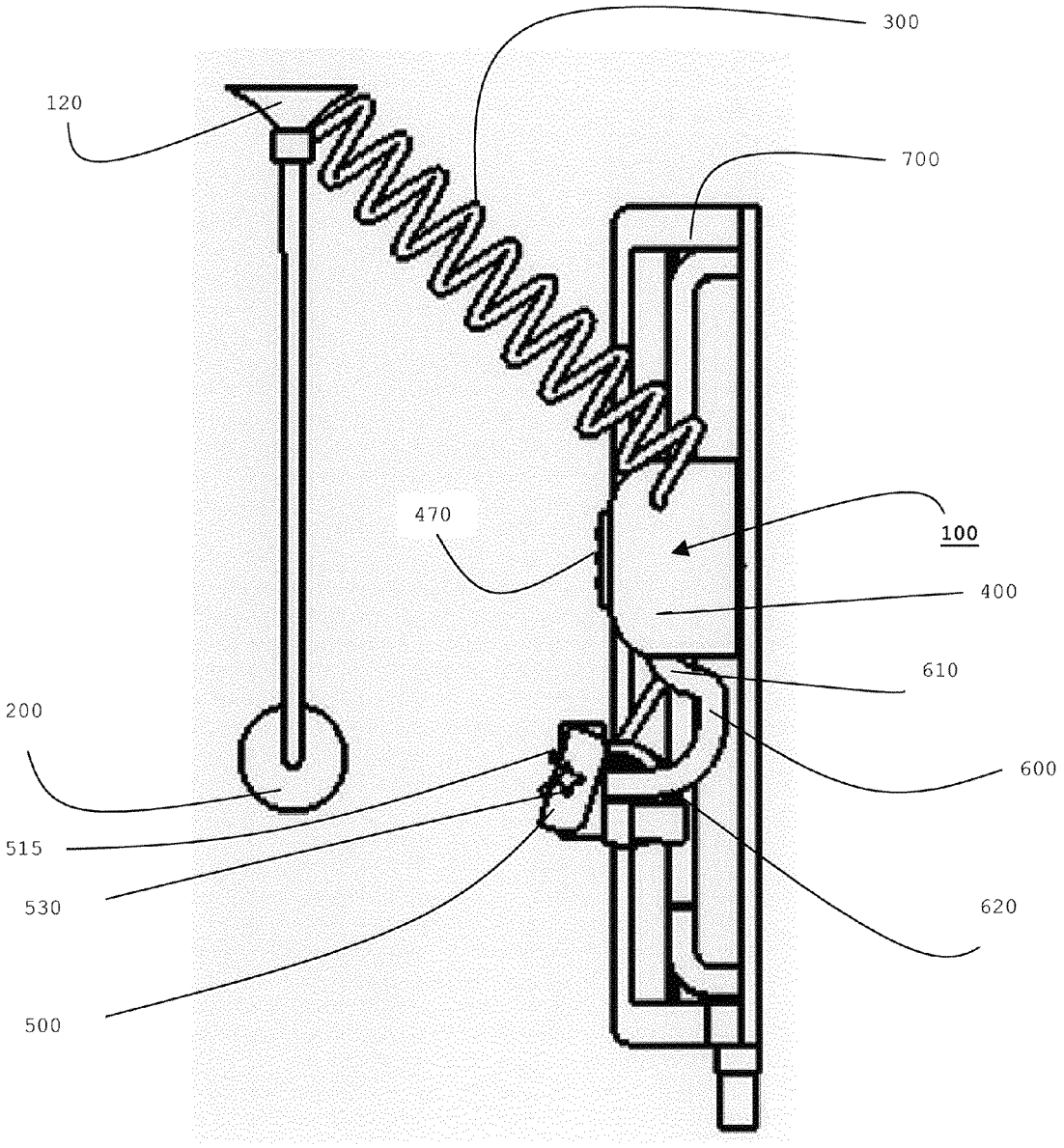
FIG. 8 is a top view of the shower attachment.

FIG. 8 offers a top view of the shower attachment 100 illustrating the compact and space saving nature of the design.

Method of Use

The invention is further directed to a method of using the shower attachment 100 to provide an improved shower to a user. The method first includes the step of vertically positioning a shower wand 500 to a desired height about the shower enclosure 110. As shown in FIG. 2B, the shower wand 500 is connected to a vertical assembly 400 by a pivot arm 600 having a first portion 610 and corresponding second portion 620 which are connected via an elbow 630. The vertical assembly 400 includes a stabilizing bar 420 having a top end 421 and corresponding bottom end 422.

The second step of the preferred method is to horizontally position the shower wand 500 to a desired horizontal position within the shower enclosure 110 through use of a horizontal assembly 700. As shown in FIGS. 6 and 7, the horizontal assembly 700 includes a tram 770 connected to a track system 745. As further shown, the tram 770 has a recess 775 of sufficient size and dimension to receive the bottom end 422 of the stabilizing bar 420.

The third step contemplated by the method is to turn the shower wand 500 about the horizontal assembly 700. As shown in FIG. 5, one way this is accomplished is through placing the shower wand 500 within a cradle 540 having a first side 541 and corresponding second side 542 that form a "C" shaped clip 543. Positioned within the cradle 540 is a two directional second motor 550. The second motor 550 powers a rotating grip wheel 560. When the shower wand 500 is placed within the cradle 540, the rotating grip wheel 560 can engage the handle 510. In addition, the method contemplates the further step of removing the shower wand 500 from the cradle 540 to manually operate the shower wand 500.

Yet another optional step is to rotate the pivot arm 600 to a desired orientation through turning the stabilizing bar 420 about the tram 770. A fourth motor 790 located within the tram 770 (shown in FIGS. 6 and 7) can help rotate the stabilizing bar 420. Moreover, the method can further include the step of selecting the type of jets 515 (shown in FIG. 5) to be used while showering through operation of a selector 530 located on the head of the shower wand 500.

I claim:

1. A shower attachment, comprising:

a water intake;

a vertical assembly which includes a stabilizing bar, the stabilizing bar having a top end and a corresponding bottom end;

the vertical assembly includes a vertical positioning member to orient a shower wand at a desired vertical height, the vertical positioning member includes a chain drive having a top gear rotator, a corresponding bottom gear rotator, a linked chain and a first electric motor, wherein the top gear rotator includes a first gear having threads of a sufficient size and dimension to engage the linked chain, the top gear rotator positioned proximate to the top end of the stabilizing bar, wherein the bottom gear rotator includes a second gear having threads of a sufficient size and dimension to engage the linked chain, the bottom gear rotator positioned proximate to the bottom end of the stabilizing bar, and wherein the first motor is capable of driving the linked chain in either of two directions;

a pivot arm having a first portion and a corresponding second portion, the first portion connected to the stabilizing bar;

the shower wand located at the second portion of the pivot arm, the shower wand capable of receiving pressurized water from the water intake; and a horizontal assembly connected to the bottom end of the stabilizing bar, the horizontal assembly capable of affixing the shower attachment to a shower enclosure the horizontal assembly includes a track system having a first track and a corresponding second track in parallel relationship to one another;

the horizontal assembly further includes a tram having a third motor and a fourth motor;

the tram including a recess capable of securing the bottom end of the stabilizing bar of the vertical assembly;

the third motor oriented to horizontally move the vertical assembly about the shower enclosure;

the fourth motor capable of rotating the bottom end of the stabilizing bar;

a controller having a power supply is in communication with the first motor, a second motor, the third motor, and the fourth motor; and the controller further includes a memory device and a processor capable of storing and performing programs.

2. The shower attachment of claim 1, wherein:

the first portion of the pivot arm includes a sleeve of sufficient size and dimension to engage the stabilizing bar and vertically move about the shower enclosure.

3. The shower enclosure of claim 2, wherein:

the first portion of the pivot arm is also engaged with the linked chain, such that when the linked chain vertically moves it also vertically positions the pivot arm.

4. The shower attachment of claim 1, wherein:

the shower wand includes both a head having a plurality of jets and a selector.

5. The shower attachment of claim 4, wherein:

the shower wand also includes a handle which can be removed and later returned to the second portion of the pivot arm.

6. The shower attachment of claim 5, wherein:

A cradle is positioned at the distal end of the second portion of the pivot arm, the cradle having a first side and corresponding second side which form a clip to hold and maintain the handle of the shower wand.

7. The shower attachment of claim 6, wherein:

the cradle further includes the second motor capable of rotating the shower wand when placed within the clip.

8. A method of receiving a shower through a shower attachment, comprising the steps of:

(a) vertically positioning a shower wand to a desired height, the shower wand connected to a vertical assembly by a pivot arm having a first portion and a corresponding second portion, the vertical assembly including a stabilizing bar having a top end and a corresponding bottom end;

(b) horizontally positioning the shower wand to a desired horizontal position within a shower enclosure through use of a horizontal assembly, the horizontal assembly including a tram connected to a track system, the tram having a recess of a sufficient size and dimension so as to receive the bottom end of the stabilizing bar; and (c) turning the shower wand about the horizontal assembly.

9. The method of receiving a shower of claim 8, comprising the additional step of:

(d) rotating the pivot arm to a desired orientation through turning the stabilizing bar about the tram.

10. The method of receiving a shower of claim 8, wherein:

the vertical assembly also includes a vertical positioning member to orient the shower wand to the desired vertical height.

11. The method of receiving a shower of claim 8, wherein:

the vertical positioning member is a chain drive having a top gear rotator, a corresponding bottom gear rotator, a linked chain and a first motor;

the top gear rotator includes a first gear having threads of a sufficient size and dimension to engage the linked chain, the top gear rotator positioned proximate to the top end of the stabilizing bar;

the bottom gear rotator also includes a second gear having threads of a sufficient size and dimension to engage the linked chain, the bottom gear rotator positioned proximate to the bottom end of the stabilizing bar; and the first motor capable of driving the linked chain in either of two directions.

12. The method of showering of claim 1, wherein:

the first portion of the pivot arm includes a sleeve of sufficient size and dimension to engage the stabilizing bar and vertically move about the shower enclosure.

13. The method of showering of claim 12, wherein:

the first portion of the pivot arm is also engaged with the linked chain, such that when the linked chain vertically moves it also vertically positions the pivot arm.

14. The method of showering of claim 8, further comprising the step of:

selecting the type of jets to be used while showering through operation of a selector located on the head of the shower wand.

15. The method of showering of claim 8, further comprising the step of:

removing the shower wand from a cradle positioned at the distal end of the second portion of the pivot arm in order to manually operate, the cradle having a first side and corresponding second side which form a clip to hold and maintain the handle of the shower wand.

16. A method of receiving a shower using the shower attachment of claim 1, comprising the steps of:

(a) vertically positioning a shower wand to a desired height, the shower wand connected to a vertical assembly by a pivot arm having a first portion and a corresponding second portion, the vertical assembly including a stabilizing bar having a top end and a corresponding bottom end;

(b) horizontally positioning the shower wand to a desired horizontal position within a shower enclosure through use of a horizontal assembly, the horizontal assembly including a tram connected to a track system, the tram having a recess of a sufficient size and dimension so as to receive the bottom end of the stabilizing bar;

(c) turning the shower wand about the horizontal assembly;

(d) rotating the pivot arm to a desired orientation through turning the stabilizing bar about the tram.

* * * * *